United States Patent [19]

Harrison

[11] 3,942,835

[45] Mar. 9, 1976

[54] RECLINER RESTER CHAIR WITH PROJECTIBLE LEGREST AND HEADREST, AND HARDWARE THEREFOR

[75] Inventor: Kenneth S. Harrison, Ridgefield Park, N.J.

[73] Assignee: Mohasco Corporation, Amsterdam, N.Y.

[22] Filed: Dec. 23, 1974

[21] Appl. No.: 535,433

[52] U.S. Cl. ..... 297/61; 297/112; 297/403

[51] Int. Cl.[2] ..... A47C 1/03

[58] Field of Search ..... 297/61, 85, 88, 89, 112, 297/403

[56] References Cited

UNITED STATES PATENTS

| | | | |
|---|---|---|---|
| 2,958,374 | 11/1960 | Martin et al. | 297/61 |
| 3,074,758 | 1/1963 | Schliephacke | 297/61 |
| 3,132,894 | 5/1964 | Schliephacke | 297/61 |
| 3,550,952 | 12/1970 | Fegerson | 297/85 |
| 3,652,125 | 3/1972 | Rogers | 297/61 |
| 3,844,607 | 10/1974 | Re | 297/61 |
| 3,847,430 | 11/1974 | Fletcher | 297/61 |
| 3,865,432 | 2/1975 | Rogers | 297/61 |
| R25,375 | 4/1963 | Lorenz | 297/61 |

FOREIGN PATENTS OR APPLICATIONS

| | | | |
|---|---|---|---|
| 637,143 | 2/1962 | Canada | 297/61 |

*Primary Examiner*—James T. McCall
*Attorney, Agent, or Firm*—J. B. Felshin

[57] ABSTRACT

This chair is a rester which can move from upright position to T.V. position and then to fully reclined position. It has a legrest which is projected when moving from upright position to T.V. position, and retracted when going from T.V. position back to upright position. It also has a headrest which normally lies inside the backrest of the chair, when the chair is in upright position, and which swings out and projects up above the backrest, when the chair moves from upright to T.V. position. The headrest is retracted downwardly and returns into the backrest when the chair is moved from T.V. position back to upright position.

15 Claims, 2 Drawing Figures

Figure 1:
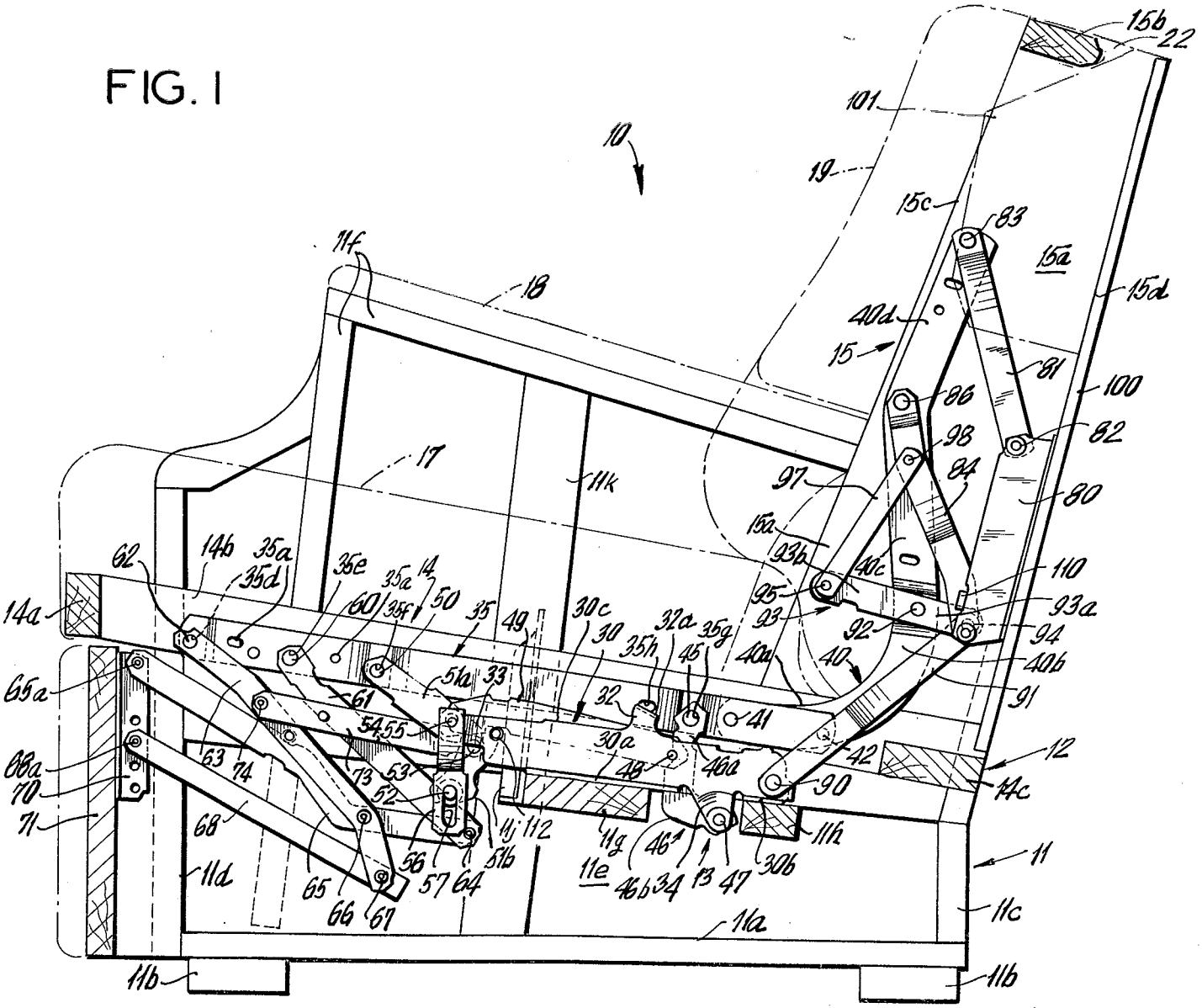

RECLINER RESTER CHAIR WITH PROJECTIBLE LEGREST AND HEADREST, AND HARDWARE THEREFOR

This invention relates to a recliner rester chain with a projectible legrest and projectible headrest, and to hardware therefor.

In my copening application Ser. No. 408,801, filed Oct. 23, 1973, there is shown a lounger with projectible legrest and headrest. One object of the present invention is to provide a rester with projectible legrest and headrest.

Another object of this invention is to provide a recliner rester chair of the character described which has a body supporting unit comprising a seat portion and a backrest portion fixed to the seat portion, and which is movable from upright position to T.V. position, and from T.V. position to fully reclined position, and a projectible headrest for said backrest portion which is projected from inside the backrest portion below the upper end of said backrest portion, to a position above said backrest portion, when moving said unit from upright position to T.V. position, and which is retracted back to inside the backrest portion below the upper end of the latter, when moving said unit from T.V. position back to upright position.

Yet another object of this invention is to provide an improved rester of the character described in which the body supporting unit cannot move from upright position to fully reclined position without first going to T.V. position, and in which the body supporting unit goes from fully reclined position to T.V. position before going back to upright position.

Still another object of this invention is to provide in a chair of the character described, highly improved hardware to permit the chair movements described above.

A further object of this invention is to provide in a chair of the character described, a legrest which is projected when the body supporting unit moves from upright to T.V. position, remains projected when said unit moves from T.V. position to fully reclined position and from fully reclined position back to T.V. position, and which is retracted when said unit is moved from T.V. position back to upright position.

A still further object of this invention is to provide, in a chair of the character described, highly improved hardware for quickly and fully projecting a headrest from retracted position, upon moving the body supporting unit of a rester from upright to T.V. position.

Yet a further object of this invention is to provide a strong, rugged and durable chair (and hardware therefor), of the character described, which shall be relatively inexpensive to manufacture, easy to assemble and operate, which shall be smooth and comfortable in use and easy for the occupant to manipulate, and which shall yet be practical and efficient to a high degree.

Other objects of this invention will in part be obvious and in part hereinafter pointed out.

The invention accordingly consists in the features of construction, combinations of elements, the arrangement of parts which will be exemplified in the construction hereinafter described and of which the scope of invention will be indicated in the following claims.

Figure 2:
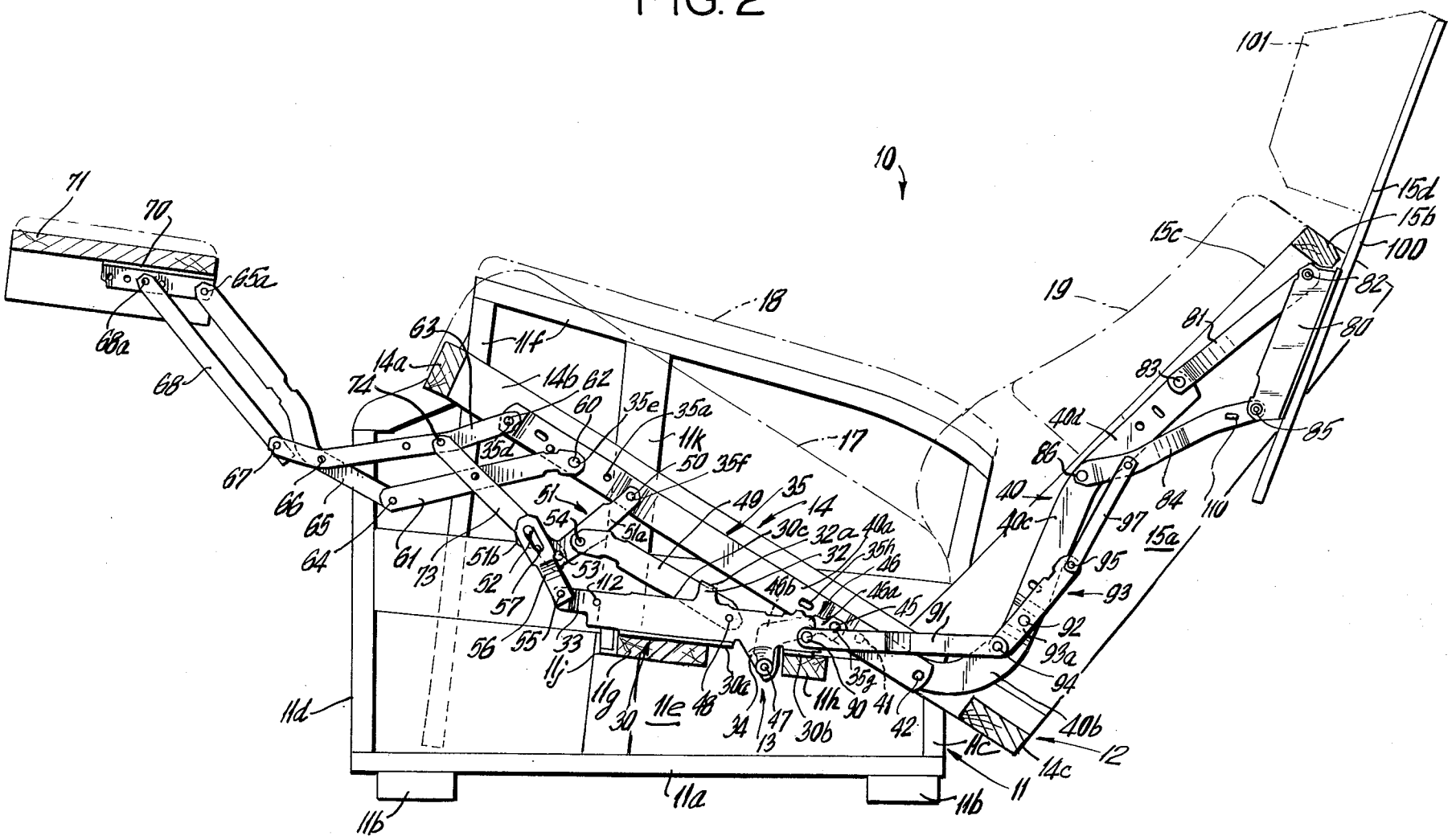

IN THE DRAWINGS:

FIG. 1 is a left facing cross-sectional view of a chair and hardware therefor, embodying the invention and shown in upright position; and FIG. 2 is a view similar to FIG. 1, but showing the chair in fully reclined position.

Referring now in detail to the drawing, 10 designates a recliner rester chair, embodying the invention and comprising a chair base 11, a body supporting unit 12 and hardware 13 therefor.

The base 11 comprises a bottom frame 11*a* supported on legs 11*b*, a rear vertical portion 11*c*, a front vertical portion 11*d*, parallel, vertical side arms 11*e* and armrests 11*f* fixed to said side arms. The side arms 11*e* are connected by cross-braces 11*g* and 11*h*.

The body supporting unit 12 comprises a set frame 14 having a front cross-bar 14*a*, parallel side bars 14*b* connected at their front ends to the front bar 14*a* and at their rear ends to a rear cross-brace 14*c*. Fixed to the seat frame 14 and movable therewith is a backrest frame 15 comprising side members 15*a* extending up from the rear ends of the side bars or portions 14*b* of the seat frame, and interconnected at their upper ends by a cross-bar 15*b*. The rear edges of the side portions 15*a*, in the upright position of the chair, are inclined somewhat upwardly and rearwardly. The seat frame 14, in the upright position of the chair, is somewhat inclined upwardly and forwardly from the lower end of the backrest frame. In the drawing, dot-dash line 17 indicates the upholstery on the seat frame, dot-dash line 18 indicates upholstery on the armrests, and dot-dash line 19 indicates upholstery on the backrest frame 15.

It will be noted that the front edge 15*c* of the side walls 15*a* of the backrest frame incline upwardly and rearwardly relative to the rear edge 15*d* of said walls. The top cross-bar 15*b* extends rearwardly of the upper ends of the front edges 15*c* but terminate short of the rear edges 15*d*, leaving a space or opening 22 at the upper end of the backrest frame.

Attached to the front edge of cross-brace 11*g* are brackets 11*j* to supply rigidity for the arm frame, in the well known matter.

Only the hardware 13 at one side of the chair is shown in the drawings, since the hardware on both sides are similar and symmetrical. In both FIGS. 1 and 2, the hardware shown is at the right side of the chair (to a person sitting in the chair) when a person on the left side of the chair is looking at the inside of the right side of the chair.

Fixed to the cross braces 11*g* and 11*h* near the right side of the chair base 11, is an arm mounting plate 30. Said mounting plate has a bottom flange 30*a* resting on cross-brace 11*g* and a bottom flange 30*b* resting on cross-brace 11*h*. Extending up from about the middle of the upper edge 30*c* of plate 30, is an arm or lug 32 which has an upper downwardly and rearwardly inclined flange 32*a* at right angles thereto. Said mounting plate 30 has a forwardly extending ear 33 at its front end. It is also provided an ear 34 extending downwardly between the cross-bars 11*g*, 11*h*.

Attached to the inside of the seat frame bar 14*b* at the right side of the chair is a seat link 35. Said seat link may be provided with slots 35*a*, 35*h* to receive fastening members for attaching said seat link to said bar 14*b*. The lower edge of the seat link may be located substantially at the lower edge of said bar 14*b*. When the chair is in upright position, as shown in FIG. 1, the front end of the seat link is spaced somewhat rearwardly of the front portion 14*a* of the seat frame 14 but considerably forward of plate 30. At its front end, the seat link 35 has an opening 35*d* for purpose hereinafter appearing. Rearwardly of opening 35*d*, the seat link is formed with an opening 35*e* for the purpose explained hereinafter. Rearwardly of opening 35*e*, said seat link 35 has a opening 35*f* for the purpose set forth hereinafter. In the upright position of FIG. 1, opening 35*f* is deposed forwardly of the front end of mounting plate 30. Said seat link 35 also has an opening 35*g* disposed rearwardly of arm or lug 32, when the chair is in the upright position of FIG. 1. Said seat link also has a slot 35*h* substantially aligned with flange 32*a*, as seen in FIG. 1.

The rear end of each seat link terminates short of rear seat frame cross-bar 14*c*.

Fixed to the rear end of each seat link (right and left) is a backrest mounting member 40 having a lower forwardly extending arm 40*a* overlapping and contacting the rear end portion of the seat link and fixed thereto by rivets 41, 42. Extending upwardly from lower arm 40*a* is a curved portion 40*b* from which a portion 40*c* inclines upwardly and forwardly, in the upright position of the chair as seen in FIG. 1. Extending from the upper end of said portion 40*c*, is an upwardly and rearwardly inclined portion 40*d* terminating below the cross-bar 15*b*, and being parallel to the front edge 15*c* of side frame members 15, and somewhat rearwardly of said front edge.

Pivoted to a pivot pin 45 in opening 35*g*, is the upper end of a link 46. Said link 46 has an arm 46*a* which extends upwardly, in the upright position of the chair. The pivot pin 45 passes through a suitable opening in the upper end of said arm and through said opening 35*g* in seat link 35. Extending rearwardly from the lower end of arm 46*a* is an arm 46*b* pivoted to a pin 47 in an opening in the downwardly extending ear 34 of the arm mounting plate 30, as illustrated in FIG. 1.

Pivoted to the arm mounting plate 30, as an pivot 48, is a link 49.

Pivoted to the seat link 35, on pivot pin 50 passing through opening 35*f* of the seat link, is a bellcrank 51. Said bellcrank 51, in the upright position of the chair, has an upper arm 51*a* inclined downwardly and rearwardly from the pivot pin 50. Extending downwardly and forwardly from the lower end of arm 51*a*, is an arm 51*b* carrying a pin 52. At the junction of arms 51*a*, 51*b*, said bellcrank 51 carries a pivot pin 53. The forward end of link 49 is pivoted as at 54 to arm 51*a* of bellcrank 51, above pin 53 but closer to said pin than to the pivot pin 50. In the upright position of the chair, pivots 54, 55 are coaxial.

Pivoted to the ear 33 of the mounting plate 30, as by rivet 55 is a sequence link 56 formed in its outer end with a longitudinal slot 57 through which the pin 52 passes.

In the upright position of the chair (FIG. 1), the link 56 hangs down vertically from pivot 55 and the pivot pin 52 is in the upper end of slot 57.

Pivoted to the seat link 35 on a pivot pin 60 in opening 35*e;* is a link 61. Pivoted to the seat link 35, as on pivot pin 62 in opening 35*d*, is a link 63. In the upright position of the chair, links 61, 63 slant downwardly and rearwardly. Pivoted to the lower end of link 61 as a pivot 64, is a link 65 crossing link 63 and interpivoted thereto by pivot 66. Pivoted to the outer end of link 63, as on pivot 67, is a link 68. The outer ends of links 68, 65 are pivoted, as on pivots 68*a*, 65*a*, to a footrest bracket 70. A suitable footrest 71 is fixed to the footrest brackets 70 on the right and left sides of the chair.

Pivoted to pivot 53 at the junction of arms 51*a*, 51*b* of bellcrank 51, is one end of a drive link 73. The other end of drive link 73 is pivoted, as at 74, to the link 63 between the pivot 66 and the pivot 62.

In the fully reclined position of FIG. 2, the pin 52 contacts the outer end of slot 57 to stop movement of bellcrank 51, to stop upward swinging movement of link 49 when the mechanism is in fully reclined position.

The function of the flange 32*a* on lug 32 is to prevent closing of the ottoman or legrest in the fully reclined position. If the occupant attempts to close the legrest in the fully reclined position, then the link 49 is caused to rotate further clockwise, and contacts flange 32*a* on lug 32, to prevent further closing of the legrest.

The link 49 cannot tilt up in the upright position of the chair because pin 52 is at the upper end of slot 57 of link 56 and acts as a strut to prevent upward movement of bellcrank 51. However when the chair is moved to the T.V. position, link 56 will have swung sufficiently in a clockwise direction (looking at FIG. 1) to permit movement of the link 49 to allow movement of the seat link to fully reclined position. It will be understood that the footrest linkage will be projected as the chair is moved from upright to T.V. position. The seat link moves rearwardly and tilts upwardly when going from upright to T.V. position. When going from T.V. position to fully reclined position, link 49 tilts upwardly about pivot 48 to allow the seat link 35 to tilt upwardly and rearwardly further together with further raising of the footrest linkage, and further reclining of the backrest member 40 as a unit.

The chair is provided with a headrest bracket 80 connected to the backrest mounting member 40 by a headrest idler link 81 pivoted to the upper end of the headrest bracket as by pivot pin 82, and to the upper end of said backrest mounting member as on pivot 83. Said headrest bracket 80 is also connected to the backrest mounting member 40, below pivot 83 by a headrest drive link 84. Headrest drive link 84 is pivoted to the lower end of the headrest bracket by a pivot pin 85 and is pivoted to said backrest mounting member, by pivot pin 86. Link 84 is longer than link 81. The bracket 80, links 81 and 84 and the backrest mounting member 40 form a four bar linkage for the headrest bracket.

Means is provided to project the headrest bracket 80 upon moving from upright to T.V. position, and to retain the headrest bracket in projected position upon going from T.V. position to fully reclined position. To this end there is pivoted to the rear end of the arm mounting plate 30, as by means of pivot 90, a headrest actuator link 91. Pivoted to the backrest mounting member 40, as at 92, is a headrest bellcrank lever 93. The pivot 92 is located between portions 40*b* and 40*c* of the backrest mounting member 40. In the upright position of the chair, lever 93 is almost horizontal and has a rearwardly extending arm 93*a*, the rear end of which is pivoted as by pivot 94 to outer end of headrest actuator link 91. Said bellcrank lever 93, in the upright position of the chair, also has a forwardly extending arm 93*b* pivoted, as at pivot 95 to the lower end of a headrest connecting link 97. The upper end of connecting link 97 is pivoted to the headrest drive link 84 as by pivot 98 which is closer to pivot 86 than to pivot 85. In the upright position of the chair, link 97 is inclined upwardly to the rear. In the projected position of the headrest bracket, the pivots 98, 95 and 92 are vertually in a straight line to hold the headrest in projected position, while the chair is in T.V. or fully reclined positions.

The pivot 95, however, is somewhat rearwardly past a line connecting pivots 98 and 92, in the T.V. and fully reclined positions of said chair, to lock the headrest in upwardly projected position against collapse by a downward thrust on the headrest, since the headrest must move up somewhat before it can move down, to be retracted.

In the upright position of the chair, links 81 and 84 are inclined upwardly and forwardly. In the projected position of the chair, said links 81, 84 project upwardly and rearwardly.

It will now be understood that when the chair is moved from upright to T.V. position, link 91 causes lever 93 to rotate in a clockwise direction, looking at FIG. 1, to swing pivot point 95 upwardly and causing the connecting link 97 to swing the link 84 in a counterclockwise direction to project the headrest bracket upwardly and rearwardly and then upwardly and forwardly.

Fixed to the headrest brackets 80, on both sides of the chair is a flat board 100 carrying a headrest 101 at its upper end.

In the upright position of the chair, said headrest 101 is housed within the backrest of the chair, as shown in FIG. 1.

In this position the upper end of the headrest projects into space 22 at the rear of cross rail **15*b***.

As the chair moves from upright to T.V. position, said headrest 101 moves rearwardly and upwardly to a position above said cross-rail **15*b***. This relative position is retained when going from T.V. position to fully reclined position.

A lug 110 contacts an inner edge of headrest bracket 80 in the upright position of the chair. A pin 112 on the mounting plate 30 is contacted by the lower edge of link 49 in the upright position of the chair.

It will thus be seen that there is provided a device in which the several objects of this invention are achieved and which is well adapted to meet the conditions of practical use.

As various possible embodiments might be made of the above invention, and as various changes might be made in the embodiment above set forth, it is to be understood that all matter herein set forth or shown in the accompanying drawings is to be interpreted as illustrative.

I claim

1. Hardware for a chair having an arm, comprising body supporting menas, a mounting plate adapted to be fixed relative to the arm of the chair, linkage connecting said mounting plate with said body supporting means to move said body supporting means rearwardly and to swing the front end of said body supporting means upwardly and its rear end downwardly, relative to the mounting plate from an upright position to a T.V. position; and to move said means from said T.V. position to a fully reclined position; from said fully reclined position back to said T.V. position and from said T.V. position back to said upright position, said body supporting means comprising a seat link and backrest mounting means, a lever pivoted immediately the ends thereof to said backrest mounting means, and having a forwardly extending arm and a rearwardly extending arm, in the upright position of said chair, a headrest actuator link pivoted at its lower end to said mounting plate at a point disposed below the body supporting means in the upright position of said means and pivoted at its upper end to said rearwardly extending arm, and extending upwardly and rearwardly from its pivotal connection to the mounting plate in said upright position, a connecting link pivoted at its lower end to the forwardly extending arm, in said upright position, a headrest bracket, an idler link pivotally connected to the upper end of said headrest bracket and to the upper end of said backrest mounting means, a headrest drive link pivotally connected to the lower end of said headrest bracket and to said backrest mounting means, below the upper end of the latter, and the upper end of said connecting link being pivotally connected to said headrest drive link between the pivoted ends of the latter.

2. The combination of claim 1, the pivotal connection of said lever to said backrest mounting means being located above said seat link.

3. The combination of clain 2, the pivotal connection of said drive link to said backrest mounting means being located above the pivotal connection of said lever to said backrest mounting means.

4. The combination of claim 1, said backrest mounting means being in fixed relation to said seat link for movement therewith.

5. The combination of claim 4, the pivotal connection of said lever to said backrest mounting means being located above said seat link.

6. The combination of claim 5, the pivotal connection of said drive link to said backrest mounting means being located above the pivotal connection of said lever to said backrest mounting means.

7. The combination of claim 1, the pivotal connections of the connecting link to said drive link and to said lever, and the pivotal connection of said lever to said backrest mounting means, being substantially in a straight line, in the fully reclined position of said chair.

8. The combination of claim 1, and legrest linkage connected to said body supporting means and to said mounting plate, and projectible upon moving said body supporting means from the upright to the T.V. position of the chair.

9. The combination of claim 1, the pivotal connection of said lever to said backrest mounting means being located above said seat link, the pivotal connection of said drive link to said backrest mounting means being located above the pivotal connection of said lever to said backrest mounting means, said backrest mounting means being in fixed relation to said seat link for movement therewith, the pivotal connections of the connecting link to said drive link and to said lever, and the pivotal connection of said lever to said backrest mounting means, being substantially in a straight line, in the fully reclined position of said chair.

10. The combination of claim 9, the legrest connected to said body supporting means and to said mounting plate, and projectible upon moving said body supporting means from the upright to the T.V. position of the chair.

11. A chair comprising a chair framee having a base, said base having an arm, a seat frame, a mounting plate fixed relative to said base arm, a seat link fixed to said seat frame, linkage connecting said mounting plate with said seat link to move said seat link rearwardly and to tilt the front end of said seat link upwardly and tilt the rear end of the seat link downwardly from an upright position of the chair to a T.V. position thereof, and to move said seat link from T.V. position to a fully reclined position, backrest mounting means, means to connect said seat link to said backrest mounting means, a lever pivoted mediately the ends thereof to said backrest mounting means, above said seat link, and having a forwardly extending arm and a rearwardly extending arm in the upright position of the chair, a connecting link pivoted to the forwardly extending arm, a headrest actuator link pivoted at its lower end of said mounting plate at a point below the seat link in the upright position of the seat link, and at its upper end to said rearwardly extending arm and extending upwardly and rearwardly from its pivotal point to said mounting plate, in said upright position, a headrest bracket, an idler link pivoted at one end to the upper end of said backrest bracket, and at its other end to the upper end of said backrest mounting means, a headrest drive link pivoted at one end to the lower end of said headrest bracket, and at its other end to said backrest mounting means, and means to pivotally connect the other end of said connecting link to said headrest drive link, mediately the ends of the latter.

12. The combination of claim 11, said backrest mounting means being in fixed relation to said seat link for movement therewith.

13. The combination of claim 12, said connecting link and said lever being substantially in alignment, in the fully reclined position of the chair.

14. The combination of claim 13, the pivotal connection of said drive link to said backrest mounting means being located between the pivotal connection of said lever to said backrest mounting means and the pivotal connection of said idler link to said backrest mounting means.

15. The combination of claim 1, the pivot between the lever and connecting link being rearward of a line connecting the pivotal connection of the connecting link to the drive link, with the pivotal connection of the lever to the backrest mounting means, in the T.V. and fully reclined positions of the chair.

* * * * *